US009105953B2

(12) United States Patent
Gomi

(10) Patent No.: US 9,105,953 B2
(45) Date of Patent: Aug. 11, 2015

(54) HIGH FREQUENCY LINE TO WAVEGUIDE CONVERTER COMPRISING FIRST AND SECOND DIELECTRIC LAYERS SANDWICHING AN ANTENNA WITH AN ADHESION LAYER

(75) Inventor: Koichiro Gomi, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 392 days.

(21) Appl. No.: 13/607,328

(22) Filed: Sep. 7, 2012

(65) Prior Publication Data

US 2013/0082899 A1 Apr. 4, 2013

(30) Foreign Application Priority Data

Sep. 30, 2011 (JP) ..... P2011-218757

(51) Int. Cl.
*H01P 5/107* (2006.01)

(52) U.S. Cl.
CPC ..... *H01P 5/107* (2013.01)

(58) Field of Classification Search
CPC ..... H01P 5/107
USPC ..... 333/26
See application file for complete search history.

(56) References Cited

U.S. PATENT DOCUMENTS 7,479,841 B2 * 1/2009 Stenger ..... 333/26
7,750,755 B2 7/2010 Fujita et al.
7,884,682 B2 * 2/2011 Nagaishi et al. ..... 333/26
7,911,292 B2 * 3/2011 Byun et al. ..... 333/26
2003/0048993 A1 3/2003 Shi et al.
2007/0085626 A1 * 4/2007 Lee et al. ..... 333/26
2007/0262828 A1 * 11/2007 Fujita ..... 333/26

FOREIGN PATENT DOCUMENTS

DE 102007005928 A1 8/2007
EP 1923950 A1 5/2008
JP 2007-060714 3/2007
JP 2010-130433 6/2010
JP 2011-218757 11/2011

OTHER PUBLICATIONS

Official Action dated May 10, 2013; German Patent Application No. 10 2012 216 513.4.

* cited by examiner

*Primary Examiner* — Benny Lee
(74) *Attorney, Agent, or Firm* — Patterson & Sheridan, LLP

(57) ABSTRACT

A high frequency line-waveguide converter is provided which includes a first substrate including a first dielectric layer, a first conductive layer formed on a surface of the first dielectric layer, and a conductive pattern formed on the surface of the first dielectric layer that surrounds the second conductive layer. An antenna formed on a bottom surface of the first dielectric layer at a fixed interval from the second conductive layer. The high frequency line-waveguide converter also includes a second substrate including a third conductive layer and a fourth conductive layer separated by a second dielectric layer. An adhesion layer formed between the first substrate and second substrate, a shield conductive part formed by multiple vias between the conductive pattern and the fourth conductive layer, and a conductive waveguide in contact with the fourth conductive layer.

11 Claims, 1 Drawing Sheet

HIGH FREQUENCY LINE TO WAVEGUIDE CONVERTER COMPRISING FIRST AND SECOND DIELECTRIC LAYERS SANDWICHING AN ANTENNA WITH AN ADHESION LAYER

CROSS-REFERENCE TO RELATED APPLICATION

This application is based upon and claims the benefit of priority from Japanese Patent Application No. 2011-218757, filed Sep. 30, 2011; the entire contents of which are incorporated herein by reference.

FIELD

Embodiments described herein relate to a high frequency line-waveguide converter for converting high frequency signals, such as microwave signals and milliwave signals, etc. from a high frequency line of a plane circuit to a propagation mode of a waveguide.

BACKGROUND

In recent years, microwaves of 1-30 GHz and millimeter waves of 30-300 GHz have been used for information transfer, and systems utilizing high frequency signals, for instance, high-capacity communication systems at 60 GHz, or vehicle-mounted radar systems at the 76 GHz band, have been widely used. It is important, in these high frequency circuits, that are used in high frequency systems, to provide reduced-loss connections between high frequency IC's and an antenna. Particularly in systems using millimeter wave signals, the waveguide very often becomes the interface of the antenna, and broad-band high frequency line-waveguide converters with low loss are needed.

A conventional, high-frequency, line-waveguide converter typically includes a structure sandwiching a dielectric substrate, with a high frequency line, between a waveguide formed in a rectangular metallic block and a metallic short-circuit block. In the structure utilizing the short-circuit block, external leakage of electromagnetic waves in the mode conversion circuit connecting the high frequency line to the waveguide, is prevented by the short-circuit block.

In the case of installing the short-circuit block, however, there are two problems. First, the short-circuit block needs to separate parts that may cause the short-circuit. Second, the line-waveguide converter requires ample mounting space for mounting the short-circuit block.

Due to these disadvantages, a high frequency line-waveguide converter which does not use short-circuit block has been developed. However, electromagnetic waves may easily escape to the outside, and the conversion loss may be large since the short-circuit structure is constituted in a substrate having large loss and high permittivity as compared with air. Moreover, the matching range band is undesirably narrowed.

BRIEF DESCRIPTION OF THE DRAWINGS

FIG. 1A is a top view, and FIG. 1B is a cross-sectional view along the line A-A of FIG. 1A.

DETAILED DESCRIPTION OF THE INVENTION

In general, according to one embodiment, a high-frequency line-waveguide converter relating to the embodiment of the present disclosure will be explained in detail by referring to the figures.

According to the embodiment, there is provided a broad-band high-frequency line-waveguide converter with low conversion loss.

The high frequency line-waveguide converter in the embodiment has a first substrate including a first dielectric layer, a first conductor layer formed on the top surface of the first dielectric layer, a conductor pattern, which is formed on the top surface of the first dielectric layer in a manner that encapsulates the first conductor layer at regular spacing intervals. A second conductor layer is formed on the bottom surface of the first dielectric layer, and an antenna, which is formed on the bottom surface of the first dielectric layer, but is spaced a fixed interval from the second conductor layer. A second substrate including a second dielectric layer is formed at a second conductor layer side. A third conductor layer is formed on the top surface of the second dielectric layer, and a fourth conductor layer formed on the bottom surface of the second dielectric layer. An adhesion layer is formed between the first substrate and second substrate, a shield conductor part, which is formed as multiple through-holes between the conductor pattern and the fourth conductor, and a waveguide is formed so as to be contacted by, and electrically connected with, the fourth conductor layer.

Figure 1A:
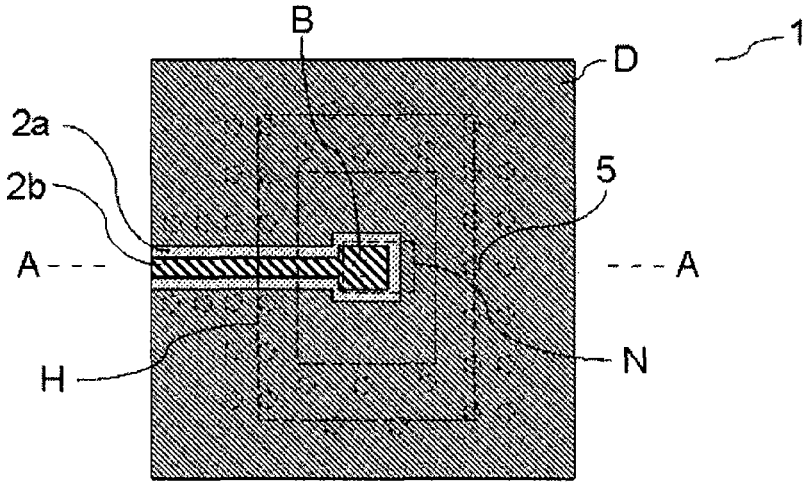
FIGS. 1A and 1B are schematic illustrations of a high-frequency line-waveguide converter according to an embodiment.
Figure 1B:
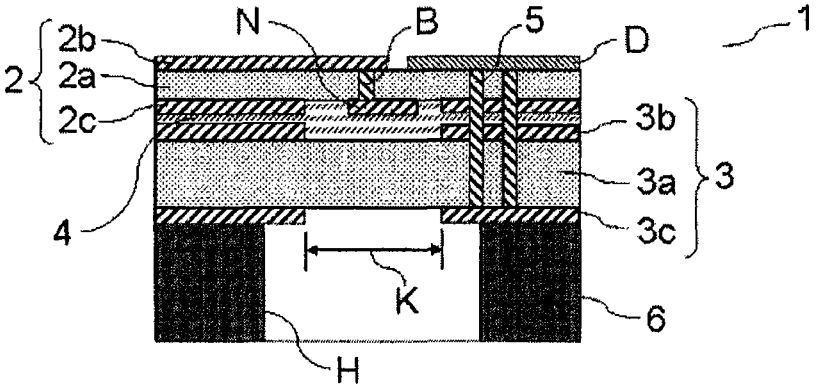

As shown in FIGS. 1A, 1B, the high-frequency line-waveguide converter 1 relating to the embodiment of the invention is composed of first substrate 2 (FIG. 1 *b*), blind via-hole B, antenna N, second substrate 3 (FIG. 1 *b*), adhesion layer 4 (FIG. 1 *b*), sealed conductor part 5 and conductive waveguide 6 (FIG. 1 *b*).

First substrate 2 includes first dielectric layer 2*a*, first conductor layer 2*b* and conductor pattern D installed on the top surface of first dielectric layer 2*a*, and second conductor layer 2*c* (FIG. 1*b*) arranged at the bottom surface of first dielectric layer 2*a*. Conductor pattern D and second conductor layer 2*c* are a pattern at ground potential (e.g., a ground) at high frequency. In first substrate 2, there is antenna N which is formed on the bottom surface of first dielectric layer 2*a*, but at a fixed spacing from second conductor layer 2*c*.

First conductor layer 2*b* forms a signal line, which is a high frequency line that is coplanar with one or both of the conductor pattern D and the first dielectric layer 2*a* in this embodiment. While the first conductor layer 2*b* is coplanar in this embodiment, first conductor layer 2*b* is not limited to this constitution, and first conductor layer 2*b* may be a microstrip line. First conductor layer 2*b* is connected to a semiconductor chip which is not shown. Further, conductor pattern D is formed so as to enclose first conductor layer 2*b* while leaving a gap of about 0.1 mm therearound. Antenna N is connected to first conductor layer 2*b* through blind via-hole B.

Since the high-frequency line-waveguide converter 1 is configured as above, the high frequency signal applied to the first conductor 2*b* can be fed directly to antenna N without the risk of radiation emission into the air layer of the top surface. More particularly, the high-frequency line-waveguide converter 1 can reduce emission losses, without the use of a short-circuit block.

Second substrate 3 is installed so as to be in contact with second conductor layer 2*c* of first substrate 2 through adhesion layer 4. More specifically, adhesion layer 4 is provided between the second conductor layer 2*c* and the second substrate 3.

Second substrate 3 includes second dielectric layer 3*a*, third conductor layer 3*b* formed on the top surface of second dielectric layer 3*a*, and fourth conductor layer 3*c* arranged at the bottom surface of second dielectric layer 3*a*, as shown in FIG. 1B. Third conductor 3*b* and fourth conductor layer 3*c* are patterns at ground potential (e.g., a ground) at high frequency. An interval K (shown in FIG. 1B) is formed as a space between second conductor 2*c*. Third and fourth conductor layers 3*a*, 3*c* are formed to include the same spacing intervals as the interval K of second conductor layer 2*c* which is formed at a constant spacing interval with respect to antenna N. This provides a uniform tube width of a dielectric waveguide, and facilitates satisfactory wave propagation therein.

The adhesion layer 4 is formed between first substrate 2 and second substrate 3 so as to surround a part of first and second dielectric layers 2*a*, 3*a*, second and third conductor layers 2*c*, 3*b*, and antenna N. Furthermore, the adhesion layer is formed from nonconductive materials.

Sealed conductor part 5 is a through-hole formed between conductor pattern D and fourth conductor 3*c* and is installed so as to surround antenna N. In this manner, the dielectric waveguide is formed, and, particularly, leakage of electromagnetic waves radiating from antenna N, can be reduced or eliminated.

Furthermore, conductor pattern D, second, third, and fourth conductor layers 2*c*, 3*b*, 3*c* are together patterns at ground potential (e.g., a ground), and are connected in high frequency to ground potential by the through-hole of the sealed conductor part 5.

Conductive waveguide 6 is installed to be in contact, as well as in electrical conductivity (i.e., communication) with, fourth conductor layer 3*c* of second substrate 3. In conductive waveguide 6, an opening H is provided, which is wider than the interval K of second conductor layer 2*c*, is formed at a constant spacing with respect to antenna N as well as interval K.

Dielectric materials used for forming first and second dielectric layers 2*a*, 3*a* include ceramic materials containing, as the main component, aluminum oxide, aluminum nitride, silicon nitride, mullite, etc., glass or glass ceramics, obtained by firing a mixture of glass and ceramic filler, organic resin type materials such as epoxy resin, polyimide resin, fluorine-based resin like tetrafluoroethylene resin, etc., and organic resin-ceramic (including glass) composites, etc.

Conductive components include metallic materials, containing, as the main component, tungsten, molybdenum, gold, silver, copper, etc., or metal foil containing, as the main component, gold, silver, copper, aluminum, etc. are used as materials forming first to fourth conductor layers 2*b*, 2*c*, 3*b*, 3*c*, antenna N, blind via-hole B, and sealed conductor part 5.

The adhesion layer 4 is set to make the distance from the antenna N and the second dielectric layer 2*a* to the fourth conductor layer 3*c* in order to be a λg/4, which becomes an impedance inversion circuit. Furthermore, λg is the in-tube wavelength of the dielectric waveguide formed by sealed conductor parts 5.

Since the distance from the antenna N to fourth conductor layer 3*c* of second substrate 3 is set to be λg/4, impedance is set so as to satisfy $Ze=(ZpxZw)^{1/2}$, wherein Zp(Ω) is the impedance of antenna N, Ze(Ω) is the characteristic impedance of dielectric waveguide, and Zw(Ω) is the characteristic impedance of conductive waveguide 6.

Antenna N is connected to first conductor 2*b* through blind via-hole B, but possesses a function of converting the impedance ratio at the high frequency line, including first conductor 2*b*, and impedance Zp of antenna N, to the appropriate conversion ratio.

The connection position of antenna N and via-hole B is controlled to match the impedance of the high frequency line (e.g., the first conductor layer 2*b*).

The characteristic impedance of the dielectric waveguide becomes about 200-350Ω when the characteristic impedance of first conductor layer 2*b* in this embodiment is, about 50Ω. The impedance of antenna N is about 100-200Ω and characteristic impedance of conductive waveguide 6 (WR-10, 75-110 GHz) is about 300-600Ω.

Matching of characteristic impedance, about 50Ω, of first conductor layer 2*b*, and impedance of about 100-200Ω of antenna N, can be controlled by controlling the connection position of blind via-hole B.

Matching the impedance of the antenna N, is also controlled by arranging an impedance inversion circuit between antenna N and conductive waveguide 6. Since impedance conversion is carried out by two conversion circuits between the high frequency line and antenna N, and between antenna N and conductive waveguide 6, widening of the matching range is possible. The band of −20 dB or lower is about 2.5 GHz in the conventional structure, but it becomes about 4 GHz in the high-frequency line-waveguide converter 1, and further band widening can be realized.

Conductive waveguide 6 is composed of metal, for example a noble metal such as gold, silver, etc., and is utilized for reducing conductor loss by electric current and/or corrosion prevention. The metal may be used to coat the tube inner wall within conductive waveguide 6. Materials other than metal may be used for the conductive waveguide 6. For example, a resin may be used by forming the conductive waveguide 6 to the necessary waveguide shape. When resin is used, the tube inner wall is coated with a noble metal, such as gold, silver, etc.

According to the present embodiment, high frequency line-waveguide converter 1 is formed by installing first conductor layer 2*b* on the top surface of first dielectric layer 2*a* of first substrate 2 and connecting antenna N, arranged on the bottom surface of first dielectric layer 2*a* to first conductor layer 2*b* through blind via-hole B. Next, first conductor layer 2*b* is enclosed by conductor pattern D installed on the top surface of first dielectric layer 2*a*. Sealed conductor part 5, which is composed of a plurality of through-hole lines, is formed by providing holes through the conductor pattern D to a depth that provides contact with fourth conductor layer 3*c* of second substrate 3. The sealed conductor part 5 is formed to surround antenna N, which forms dielectric waveguide. The high-frequency line-waveguide converter 1 is formed so as to make the distance from antenna N to the surface of fourth conductor 3*c* is set to λg/4.

High frequency lines composed of first conductor layer 2*b* and antenna N are connected by blind via-hole B, and the high frequency line is enclosed with conductor pattern D so that leakage of electromagnetic radiation to the air layer is inhibited to reduce conversion loss. Furthermore, leakage of electromagnetic waves being emitted from antenna N to the outside of the dielectric waveguide is inhibited by sealed conductor part 5, composed of a plurality of through-hole lines installed so as to enclose antenna N so that conversion loss, is reduced.

Band widening of the matching range can be realized by two impedance conversion circuits, namely, an impedance conversion circuit by dielectric waveguide having length of λg/4 and an impedance conversion circuit composed of the selective connection between the high frequency line and antenna N by blind via-hole B.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A high frequency line-waveguide converter, comprising:

a first substrate including:

a first dielectric layer, a first conductive layer disposed on an upper surface of the first dielectric layer, a second conductive layer disposed on a lower surface of the first dielectric layer, and a conductive pattern formed on the upper surface of the first dielectric layer so as to surround the first conductive layer with a defined gap therebetween;

a second substrate disposed below the lower surface of the first substrate, the second substrate including:

a second dielectric layer, a third conductive layer disposed on an upper surface of the second dielectric layer, and a fourth conductive layer disposed on a lower surface of the second dielectric layer;

an antenna disposed on the lower surface of the first dielectric layer and at a fixed distance from the second conductive layer;

an adhesion layer disposed between the first substrate and the second substrate, and covering the second conductive layer, the antenna, and the third conductive layer; and a plurality of conductive portions disposed between the conductive pattern and the fourth conductive layer.

2. The high frequency line-waveguide converter of claim 1, further comprising:

a conductive waveguide disposed adjacent the fourth conductive layer, the conductive waveguide being in electrical conductivity with the fourth conductive layer.

3. The high frequency line-waveguide converter of claim 2, wherein the second conductive layer has an opening in which the antenna is formed, and the conductive waveguide includes an opening that is greater than the opening formed in the second conductive layer.

4. The high frequency line-waveguide converter of claim 1, wherein a dielectric waveguide is formed in a region of the second dielectric layer surrounded by the conductive portions.

5. The high frequency line-waveguide converter of claim 4, wherein a distance between the antenna and the lower surface of the second dielectric layer is set to be $\lambda g/4$, wherein $\lambda g$ is a wavelength of a signal transmitted from the antenna.

6. The high frequency line-waveguide converter of claim 1, wherein the second conductive layer has an opening in which the antenna is located.

7. The high frequency line-waveguide converter of claim 6, wherein the third conductive layer has an opening that corresponds to the opening in the second conductive layer in a thickness direction of the converter.

8. The high frequency line-waveguide converter of claim 6, wherein the fourth conductive layer has an opening that is aligned with the opening in the second conductive layer along a thickness direction of the converter.

9. The high frequency line-waveguide converter of claim 1, wherein the defined gap exposes the first dielectric layer between the conductive pattern and the first conductive layer.

10. The high-frequency line-waveguide converter of claim 1, wherein a via is disposed in the first dielectric layer and connects the first conductive layer to the antenna.

11. The high-frequency line-waveguide converter of claim 1, wherein the fourth conductive layer has an opening and the lower surface of the second dielectric layer is exposed at the opening.

* * * * *